US006280206B1

(12) United States Patent
Kuroda et al.

(10) Patent No.: US 6,280,206 B1
(45) Date of Patent: Aug. 28, 2001

(54) HIGH-VOLTAGE CONNECTOR

(75) Inventors: Keiji Kuroda, Amagasaki; Isao Kodani, Toyonaka, both of (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/450,379

(22) Filed: Nov. 29, 1999

(30) Foreign Application Priority Data

Nov. 30, 1998 (JP) ..... 10-338593

(51) Int. Cl.[7] ..... H01R 12/00
(52) U.S. Cl. ..... 439/83; 439/79; 439/871
(58) Field of Search ..... 439/83, 871, 79

(56) References Cited

U.S. PATENT DOCUMENTS 4,224,486 * 9/1980 Zimmerman, Jr et al. ..... 200/51.1
4,732,565 * 3/1988 Ito et al. ..... 439/79
4,826,450 * 5/1989 Crane et al. ..... 439/578

* cited by examiner

*Primary Examiner*—Paula Bradley
*Assistant Examiner*—Truc Nguyen
(74) *Attorney, Agent, or Firm*—Antonelli, Terry, Stout & Kraus, LLP

(57) ABSTRACT

A high-voltage connector consists of a male assembly (1) that mates a female assembly (2) having an insulating housing (3) and pin contacts (4). Each pin contact has a pin body (15) parallel to an axis of the housing and facing its opening, a lead (17,18) continuing from the body and an exposed portion (19) to be soldered to a printed circuit board. The leads are bent sideways in opposite directions to make the soldered portions more spaced than the pin bodies. The male assembly has a partition (7) in the housing and intermediate the pin bodies, its free end located close to the opening. The female assembly has a housing (21) and socket contacts (22) secured on wire ends, this housing inserted into the first housing (3) causes the socket contacts to fit on the pin bodies. The bifurcated second housing has a recess (23) fitting on the partition such that cylindrical compartments (24) receive separated socket contacts, which are laid on their sides to have lances (34) close to opposite side walls of the housing, and latch means (27) formed in it lock the lances, to make the connector lower in height and to reduce linear and spatial distances between the contacts.

5 Claims, 5 Drawing Sheets

HIGH-VOLTAGE CONNECTOR

BACKGROUND OF THE INVENTION

1. Field of the Invention

The present invention relates to a high-voltage connector for use with electronic apparatuses driven nowadays with higher voltages, and more particularly to a connector used with high-voltage power source circuits that will activate the back-light devices in such liquid crystal displays as built in certain personal computers, wherein the circuits may be some printed inverter circuit boards that have recently been made smaller and smaller in size and in height.

2. Prior Art

The current notebook type personal computers, for example, have been required to comprise as large liquid crystal displays as possible within a de-limited dimension which the computer body frames afford. Such enlarge displays have necessitated higher voltages amounting to 1000–1400 volts or so to activate the back-light illuminators. Since the printed inverter boards, viz., the power sources, for feeding electric energy to the back-lights have usually been set in those body frames, such larger displays have reduced the surface mount areas allotted to the printed inverter boards, causing same to be made smaller in size.

Connectors each electrically connecting the smaller-sized printed inverter board to the back-light device have thus to be smaller and nevertheless resistant to high voltages. The present applicant has therefore filed a patent application for an invention as disclosed in the Japanese Laying-Open Gazette No. 10-172649. In this preceding invention, linear distance and spatial distance between the contacts in the connector were increased so that it could withstand high voltages.

SUMMARY OF THE INVENTION

However, the current market more strongly demands the notebook type personal computers rendered much lighter in weight and much thinner in shape. An object of the present invention that was made to meet these requirements is therefore to provide a high-voltage connector not only assuring the shortened linear and spatial distances between the contacts but also having a reduced overall height, by improving the connector proposed in the Gazette No. 10-172649.

In order to achieve this object, a high-voltage connector that is provided herein does consist of a male assembly as one of the mating parts of the connector and a female assembly as the other mating part, the male assembly comprising a first insulating housing and a pair of pin contacts held therein. Each of the pin contacts consists of a contacting pin body extending in parallel with a center line of the insulating housing and facing an opening thereof, and a lead continuing from the pin body and exposed outside the housing to form a solderable portion capable of being soldered to a printed circuit board. The leads are bent sideways in opposite directions such that the solderable portions are spaced from each other a distance greater than that between the pin bodies. The male assembly further comprises an internal partition disposed in the housing and intermediate the pin bodies, and having a free end that is located closer to the opening of the housing than free ends of the pin bodies are. On the other hand, the female assembly comprises a second insulating housing and a pair of socket contacts held therein and securable on respective wire ends. The second housing, that is insertable into the first housing through the opening thereof so as to cause the socket contacts to fit on the respective pin bodies, has a recess fittable on the partition such that a pair of cylindrical compartments are formed in the second housing to render it bifurcated and to accommodate the respective socket contacts isolated from each other. Characteristically, those socket contacts having respective lances are laid on their sides (in other words, "upside sideways") such that the lances are respectively disposed close to opposite side walls of the second housing, wherein the side walls have formed therein latch means for holding the lances in place.

THE PREFERRED EMBODIMENTS

Figure 1:
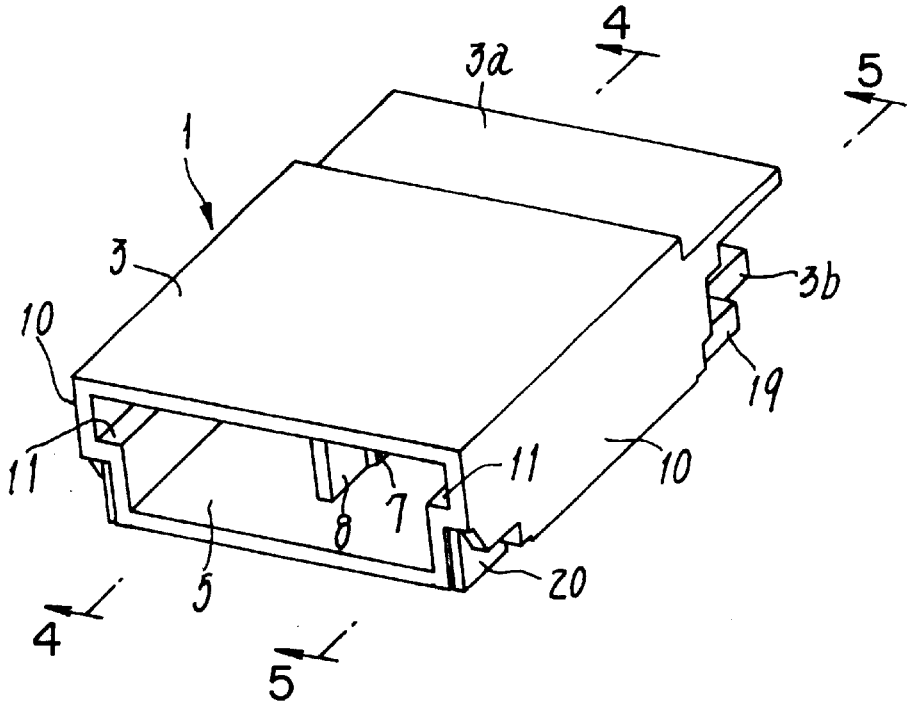
FIG. 1 is a perspective view of a male assembly constituting a connector of the present invention.

Some preferable embodiments of the present invention will now be described referring to the drawings. A high-voltage connector provided herein consists of a male assembly shown in FIG. 1 and a female assembly shown in FIG. 2.

Figure 3:
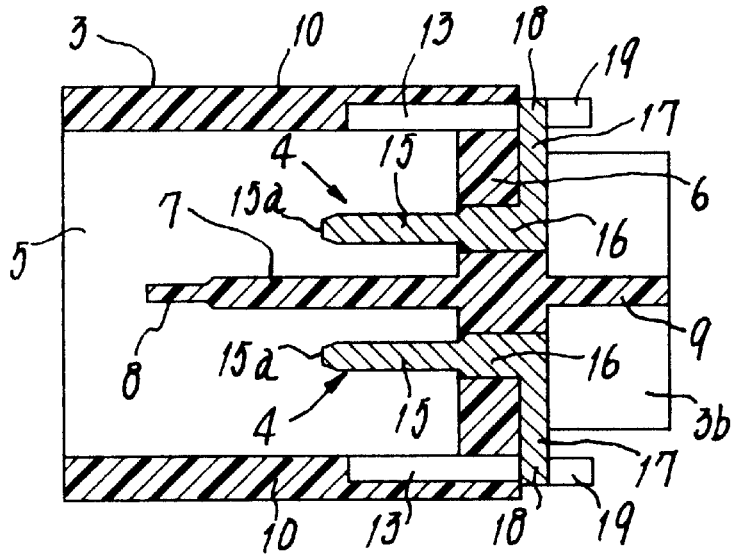
FIG. 3 is a horizontal cross section of the male assembly.
Figure 4:
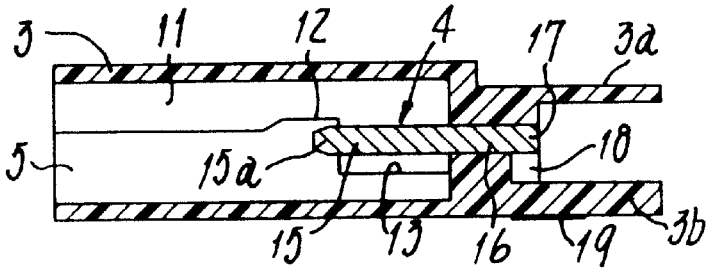
FIG. 4 is a cross section taken along the line A—A in FIG. 1.
Figure 5:
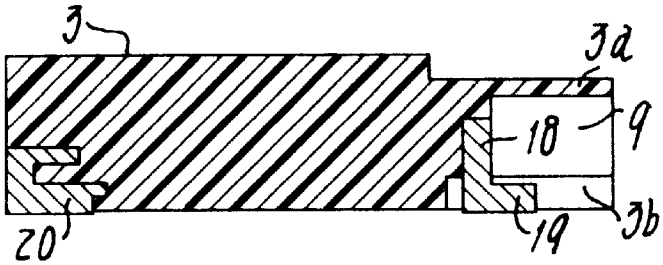
FIG. 5 is a cross section taken along the line B—B in FIG. 1.
Figure 6:
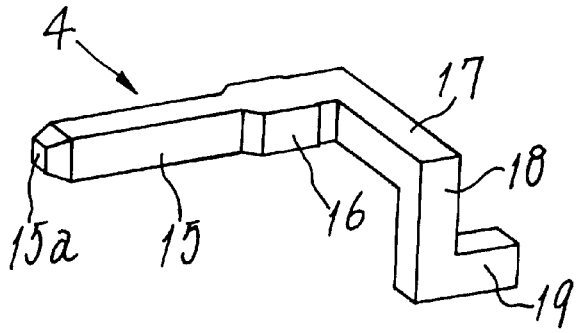
FIG. 6 is a perspective view of a pin contact.

FIGS. 1 and 3 to 6 illustrate the male assembly included in the connector and comprising a first insulating housing 3 and a pair of pin contacts 4 held in place therein. As best seen in FIG. 3, the housing 3 has a forward opening 5, a rear wall 6 and an inner partition 7 extending from a middle portion of the rear wall 6 and towards the opening 5. The partition 7 is, as discussed below again, disposed intermediate the pin contacts 4 and 4. A thinned free end 8 of the partition 7 is located closer to the opening than free ends of contacting pin bodies 15 and 15. An external partition 9 protrudes rearwardly from the middle portion of the rear wall 6 (and in alignment with the internal partition). An upper end of the external partition 9 continues to an upper extension 3*a* of the housing 3, with a lower end of said partition 9 continuing to a lower extension 3*b* of said housing 3. The lower extension 3*b* is made narrower than the upper extension 3*a*, lest solderable portions 19 detailed below should interfere with the lower extension. Guide grooves 11 formed in inner faces of opposite side walls 10 of the housing 3 extend from the opening 5 to the rear wall 6. Formed at and integral with an innermost region of each guide groove 11 are a protrusion 12 and a recess 13 cooperating therewith to engage with a right-side or left-side one of lugs 31, that are present in the female assembly 2 as will be described below.

The pin contacts 4 may be made by punching a conductive metal sheet such as a brass sheet to prepare rods and then bending same. Each pin contact 4 consists of the contacting pin body 15 continuing to a rear portion formed as a widened base 16. Leads continuing from the respective widened bases 16 are bent sideways in opposite directions to give middle portions 17. Each middle portion is bent downwards at its lateral end to form a leg 18, whose lower end is bent rearwards to provide a solderable portion 19. Both the bases 16 of pin contacts 4 are fixedly set in place through the rear wall 6, each in such a position that the pin bodies 15 extend towards the opening 5 in parallel with the center line of the housing 3. The internal partition 7 separates those bodies 15 from each other, and the solderable portions 19 of the pin contacts thus accommodated in the housing take their positions remote sideways from each other. The pin bodies 15 of the pin contacts 4 have their tip ends 15*a* located rearwardly of the thinned free end 8 of the partition 7, closer to the rear wall 6 than said end 8 is. By virtue of such an arrangement, a virtual linear distance along the rear wall as well as a spatial distance between those tip ends of the pin bodies 15 are long enough to effectively avoid any problematic disorder that might result from high-voltages. Since, as mentioned above, the solderable portions 19 continuing from the respective pin bodies 15 extend sideways in opposite directions, a distance between the former is larger than that between the latter. On the other hand, the external partition 9 cooperates with the upper and lower extensions 3*a* and 3*b* of the housing to almost surround the leads and to more surely isolate the solderable portions 19 from each other. Thus, a further linear distance along the rear wall and a further spatial distance between those portions 19 are also made long enough to effectively avoid any problematic disorder that might result from high-voltages. Those increased linear distances and those increased spatial distances will collectively contribute to enhance an overall linear distance and an overall spatial distance between the pin contacts 4. Thus, high-voltages will not have any adverse and harmful effect upon the connector, notwithstanding the reduced sizes of the insulating housing 3 and the entire male assembly 1.

Bottoms of the solderable portions 19 protrude a slight distance below from the lower surface of the insulating housing 3, for the purpose of an easier soldering. A reinforcement metal piece 20 embedded in a forward lower corner of each side wall 10 also protrudes slightly and downwards from the housing's lower surface, for the same purpose.

Figure 2:
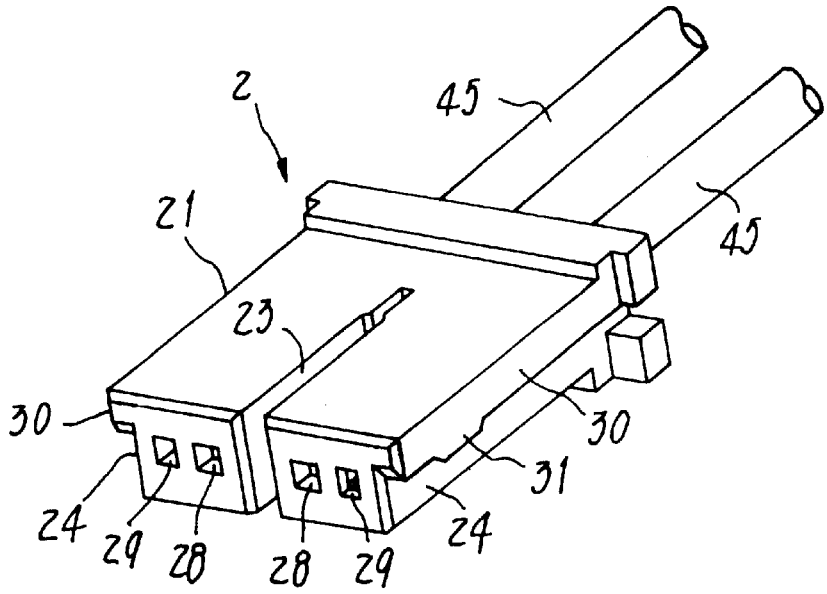
FIG. 2 is a perspective view of a female assembly also constituting the connector of the present invention.
Figure 7:
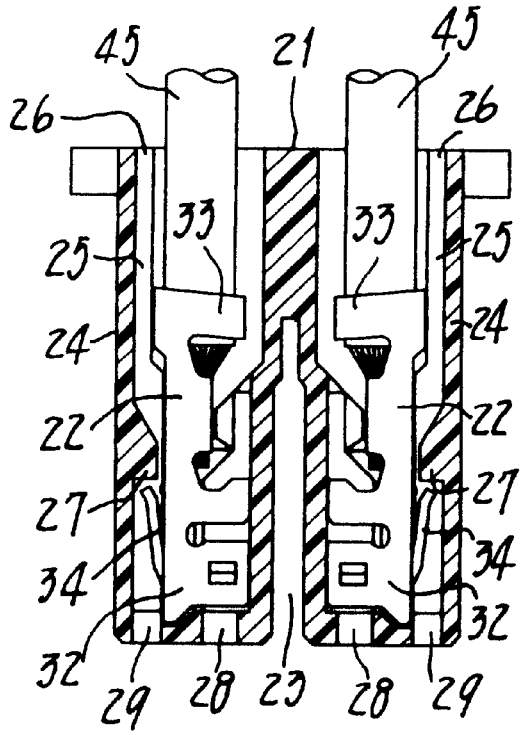
FIG. 7 is a horizontal cross section of the female assembly.

The female assembly 2 constituting the connector comprises, as shown in FIGS. 2 and 7, a second insulating housing 21 and a pair of socket contacts 22 and 22 fixed on wire ends 45. This housing is adapted to insertion into the male assembly 1 through its opening 5. The socket contacts 22 electrically connected to the wire ends 45 are separately accommodated in the second housing.

The second housing 21 is generally of a depressed rectangular parallelepiped shape. A recess 23 present in a forward middle region of this housing is for engagement with the internal partition 7 of the male assembly 1, and makes the second housing bifurcated and composed of a pair of cylindrical parts 24. A compartment 25 defined as the interior of each cylindrical part extends to a rear end of the housing 21, so that each socket contact 22 on the wire end 45 is inserted into the compartment 25 through a rear opening 26. A lance 34 protrudes sideways and outwardly from each socket contact 22. A latch means 27 for holding in place the lance 34 protrudes inwardly from an outer side wall of each compartment 25, sideways and towards the middle recess. Formed in and through a front wall of each cylindrical part 24 are holes 28 and 29, the former one 28 being for insertion of the pin contact's 4 pin body 15, with the latter 29 for insertion of a tool used to release the lance 34. A guided rib 30 (see FIG. 2) is formed integral with an outer side wall of each cylindrical part 24. This rib extending from the front end to rear end of said part will be engaged and guided by the corresponding guide groove 11 of the male assembly 1. Disposed near and behind the front end of the rib 30 is a lug 31 for engagement with the protrusion 12 of the male assembly 1.

Each of the socket contacts 22 consists of a socket portion 32 and a crimpable portion 33 formed integral therewith. The former portion is fittable on the contacting pin body 15, with the latter 33 being crimped on the wire end 45. Opened up in the bottom of each socket portion 32 is the lance 34, though when assembling, the socket contact 22 crimped on the wire end has to be placed in the compartment 25 to change its position as seen in FIG. 7. The lance 34 thus caused to face sideways lying on one of its sides will engage with the latch means 27 formed on the side wall so as to keep each socket contact in place within the housing.

Figure 8:
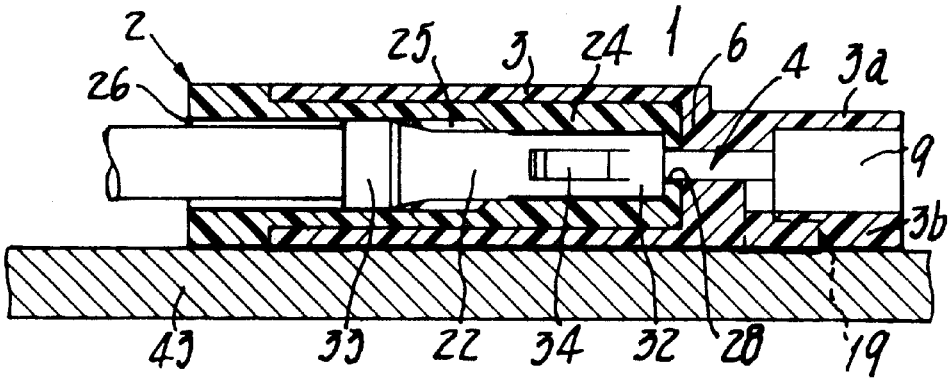
FIG. 8 is a vertically cross-sectional front elevation of the male and female assemblies constituting the connector of the present invention.
Figure 9:
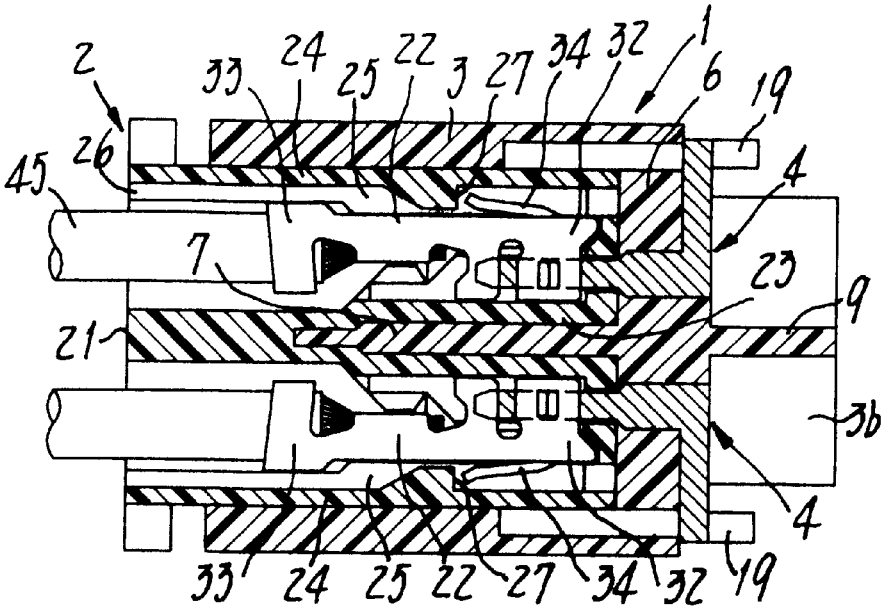
FIG. 9 is a horizontally cross-sectional plan view of the male and female assemblies constituting the connector of the present invention.
Figure 10:
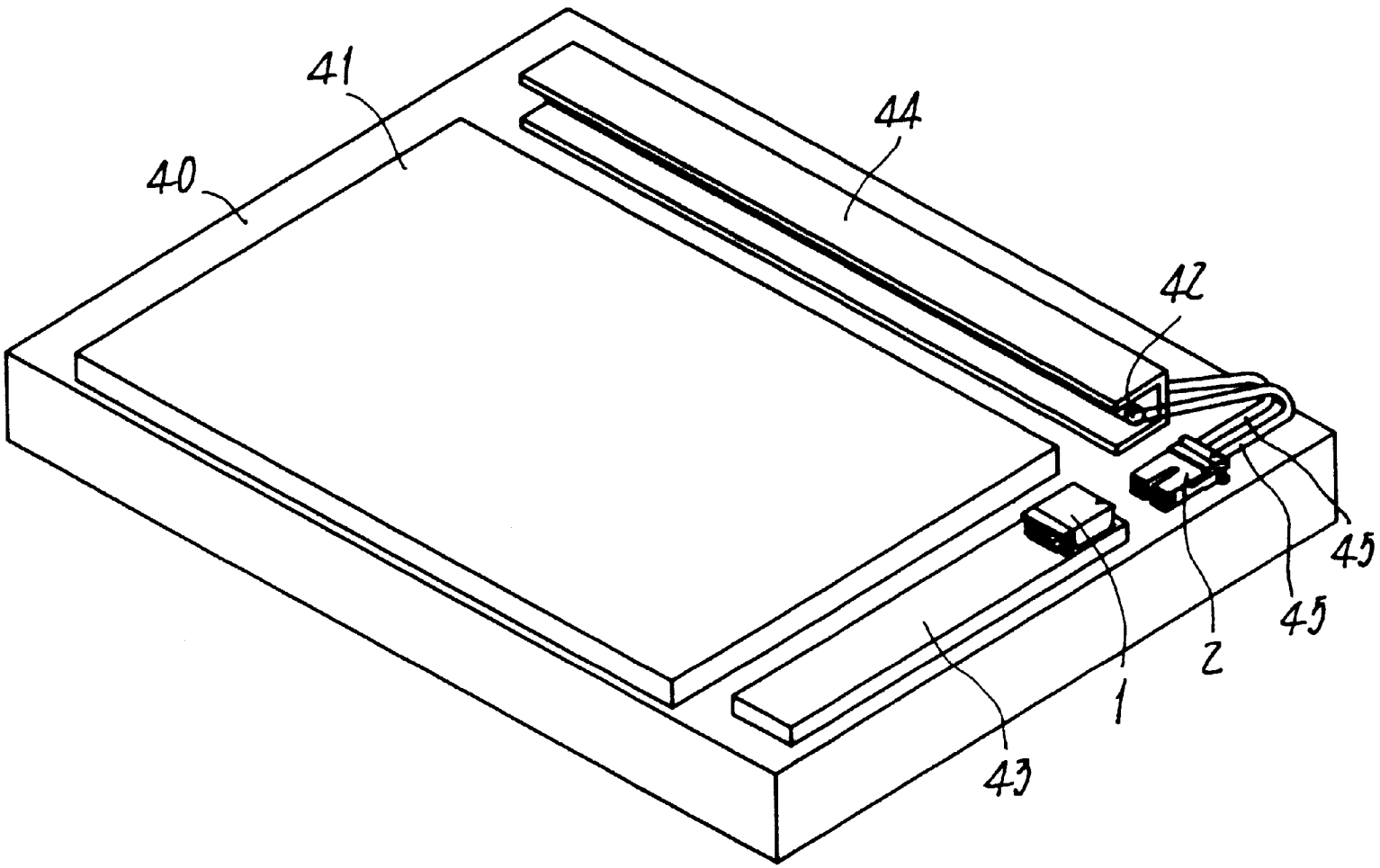
FIG. 10 is a perspective view of the connector of the invention, shown in an exemplary use.

FIGS. 8 to 10 exemplify the use of the high-voltage connector consisting of the male and female assemblies 1 and 2 and constructed in the manner described above.

Referring at first to FIG. 10, arranged on a main frame 40 of a notebook type personal computer are: a liquid crystal display 41, a back-light 42 as a light source therefor, and a printed inverter circuit board 43 as a power source activating the back-light. The reference numeral 43 denotes a reflector plate associated with the back-light 42.

The male assembly 1 of the connector will be surface mounted on the printed inverter board 43, in a manner shown in FIGS. 8 and 9, by soldering thereto both the solderable portions 19 of the pin contacts 4 and also soldering the reinforcement metal pieces 20. The male assembly 1 thus mounted on the printed board is in electric connection with the power source circuit. On the other hand, lengths of the wires 45 have their ends connected to the female assembly 2 at its socket contacts 22. The opposite ends of the wire lengths are directed to terminals of the back-light 42 and set in electric connection therewith. To render the apparatus ready for operation, the female assembly 2 of the connector will be coupled with the male assembly 1 by inserting the former into the latter through the opening 5 of the insulating housing 3. The recess 21 in the second insulating housing 21 will thereby fit on the internal partition 7, with the guided ribs 30 of this housing 21 simultaneously sliding along the guide grooves 11 formed in the first housing 3 until locked in a normal position. Also at that time, the pin bodies 15 of the male assembly pin contacts 4 will enter the respective cylindrical parts 24 through the holes 28, so as to fit in the socket portions 32 of the socket contacts 22 to thereby establish electric connection therewith. Just before completion of such a setting operation, the lugs 31 on the female assembly 2 will ride over the protrusions 12 on the male assembly 1. Those lugs 31 will immediately snap into the inner-most recesses 13, giving an operator's fingers a clicking feel to let him or her confirm snug and correct connection of relevant members, portions or parts with each other.

In this state, the linear and spatial distances between each pin contact 4 in the male assembly 1 and the corresponding socket contact 22 in the female assembly 2 are long to a sufficient extent. Therefore, any trouble such as short-circuit would not take place in spite of a considerably high voltage charged on the back-light 42 from the power source circuit formed in the printed inverter board 43.

In summary, the connector of the invention is of a remarkably reduced size in its entirety and yet improved in its resistance to high voltages owing to the lengthened linear and spatial distances between the contacting points. In particular, the socket contacts are laid on their sides to render thinner the female assembly, whereby the connector as a whole is rendered lower to be of a noticeably reduced overall height. Thus, the present connector is adapted for use, for instance with smaller and lower printed inverter boards that will operate as power source circuits for energizing the back-lights illuminating the personal computers'liquid crystal displays.

What is claimed is:

1. A high-voltage connector consisting of a male assembly mating a female assembly, the male assembly comprising: a first insulating housing, and a pair of pin contacts held therein, each pin contact consisting of a contacting pin body extending in parallel with a center line of the insulating housing and facing an opening thereof, and a lead continuing from the pin body and exposed outside the housing to form a solderable portion capable of being soldered to a printed circuit board, the leads being bent sideways in opposite directions such that the solderable portions are spaced from each other a distance greater than that between the pin bodies, the male assembly further comprising an internal partition disposed in the housing and intermediate the pin bodies, and having a free end that is located closer to the opening than free ends of the pin bodies are, the female assembly comprising: a second insulating housing, and a pair of socket contacts held therein and securable on respective wire ends, the second insulating housing being insertable into the first insulating housing through the opening thereof so as to cause the socket contacts to fit on the respective pin bodies, the second insulating housing having a recess fittable on the internal partition such that a pair of compartments are formed in the second insulating housing to render it bifurcated and to accommodate the respective socket contacts isolated from each other, wherein the socket contacts having lances laid on their sides such that the lances are respectively disposed close to opposite side walls of the second insulating housing, so that latch means formed on the side walls hold the lances in place.

2. A high-voltage connector as defined in claim 1, wherein an external partition protrudes rearwardly from a middle portion of a rear wall forming the first insulating housing, the external partition being substantially aligned with the internal partition, and wherein an upper end of the external partition continues to an upper extension of the first insulating housing, with a lower end of the external partition continuing to a lower extension of the first insulating housing so that the leads of the pin contacts are surrounded by the extensions and the external partition.

3. A high-voltage connector, comprising a male contact assembly and a mating female contact assembly, wherein the male contact assembly comprises:

a first insulating housing having side walls and a rear wall defining a cavity having an opening opposite the rear wall;

a pair of pin contacts provided in the first insulating housing, each of the pin contacts having a male pin contact body at one end portion, the male pin contact bodies extending in parallel to each other within the cavity in the first insulating housing, and a lead extending from the male pin contact body through the rear wall of the first insulating housing to form a solderable portion outside the first insulating housing capable of being soldered to a printed circuit board, the leads being bent sideways in a vicinity of the rear wall in opposite directions such that the solderable portions are spaced from each other a distance greater than a distance between the male pin contact bodies; and an internal partition disposed in the first insulating housing between the male pin contact bodies and extending from the rear wall toward the opening, and having a length from the rear wall to its free end greater than a length of each of the male pin contact bodies from the rear wall to their free ends such that the free end of the internal partition is located closer to the opening in the first insulating housing than the free ends of the male pin contact bodies;

and wherein the female contact assembly comprises:

a second insulating housing having a forward end having an outer shape corresponding to a shape of the cavity of the first insulating housing and being insertable into the first insulating housing through the opening thereof, the second insulating housing having a recess in the forward end fittable on the internal partition of the first insulating housing, the recess bifurcating the forward end of the second insulating housing into a pair of compartments;

a pair of female socket contacts, each of the pair of female socket contacts being provided in one of the pair of compartments and being fittable on one of the male pin contact bodies when the forward end of the second insulating housing is inserted into the cavity in the first insulating housing;

a lance protruding sideways and outward from each of the pair of female socket contacts; and a recess provided in a sidewall of each of the pair of compartments, whereby each lance mates with each recess to latch each female socket contact in each compartment.

4. The high-voltage connector as defined in claim 3, further comprising an external partition protruding rearwardly from the rear wall of the first insulating housing between the solderable portions of the male pin contact bodies.

5. The high-voltage connector as defined in claim 3, wherein each of the first insulating housing and the second insulating housing has a generally rectangular parallelepiped shape, wherein upper and lower major surfaces of the first insulating housing extend rearwardly beyond the rear wall to form an upper extension and a lower extension, and wherein the external partition extends from the upper extension to the lower extension so that each lead extending rearwardly beyond the rear wall and each solderable portion of each pin contact is at least partially surrounded by the upper and lower extensions and the external partition.

* * * * *